US011155755B2

(12) United States Patent
Reddy et al.

(10) Patent No.: US 11,155,755 B2
(45) Date of Patent: Oct. 26, 2021

(54) METHOD FOR OPERATING A COKER UNIT

(71) Applicant: Suncor Energy Inc., Calgary (CA)

(72) Inventors: Prabhakar Reddy, Calgary (CA); Michael Goulding, Calgary (CA)

(73) Assignee: Suncor Energy Inc., Calgary (CA)

( * ) Notice: Subject to any disclaimer, the term of this patent is extended or adjusted under 35 U.S.C. 154(b) by 0 days.

(21) Appl. No.: 16/544,517

(22) Filed: Aug. 19, 2019

(65) Prior Publication Data

US 2020/0063037 A1 Feb. 27, 2020

(51) Int. Cl.

| | |
|---|---|
| ***C10B 55/00*** | (2006.01) |
| ***C10B 57/06*** | (2006.01) |
| ***C10G 47/22*** | (2006.01) |

(52) U.S. Cl.
CPC ..... *C10B 55/00* (2013.01)

(58) Field of Classification Search
CPC ..... C10B 55/00; C10B 57/06; C10G 47/22
See application file for complete search history.

(56) References Cited

U.S. PATENT DOCUMENTS

| | | | | |
|---|---|---|---|---|
| 5,370,787 | A * | 12/1994 | Forbus, Jr. | C10G 9/00 208/106 |
| 5,711,870 | A * | 1/1998 | Storm | C10B 57/06 208/125 |
| 2014/0378728 | A1* | 12/2014 | Davis | C10G 31/06 585/535 |

* cited by examiner

*Primary Examiner* — Randy Boyer
(74) *Attorney, Agent, or Firm* — Gowling WLG (Canada) LLP

(57) ABSTRACT

Implementations of the present disclosure relate to a method of operating a coker unit comprising the steps of: collecting a coker-furnace feed stream; introducing the coker-furnace feed-stream into a coker furnace for producing a coker-drum feed stream; and introducing a hydrogen-donor gas into either or both of the coker-furnace feed stream or the coker-drum feed stream.

14 Claims, 6 Drawing Sheets

METHOD FOR OPERATING A COKER UNIT

TECHNICAL FIELD

This disclosure generally relates to processing of hydrocarbons for producing desired hydrocarbon outputs from a fractionator.

BACKGROUND

Processing of large hydrocarbons into smaller and more valuable hydrocarbons can include at least one of a thermal cracking process, a delayed coking process, a fluid coking process or a fluid catalytic cracking method. In one example of a delayed coking process, a coker unit typically includes at least one coker furnace, multiple coker drums and a fractionator. The coker furnace heats a hydrocarbon input to appropriate temperatures for thermal cracking and coking of the hydrocarbon input. The heated hydrocarbon input is then received by the coker drums. The coker drums provide a residence time at sustained temperatures that are suitable for cracking and coking the hydrocarbon input. The coking drums produce a cracked, fluid coker-drum product that is conducted to the fractionator and a solid coker-drum product, which is also referred to as coke. The multiple coker drums allow the coking process to be offset between the coker drums so there is time to clean the accumulated solid product out of a given coker drum while at least another drum is actively coking. In this fashion at least one coker drum is always producing the coker-drum product.

The cracked, fluid coker-drum product contains cracked hydrocarbons that are conducted to the fractionator. The coker-drum product is separated into various desired hydrocarbon products within the fractionator by boiling-point separation. Typically, the lighter desired hydrocarbon products, such as kerosene and naphtha cuts are the more valuable products from the fractionator.

SUMMARY

Some implementations of the present disclosure relate to a method of operating a coker unit. The method comprises the steps of: introducing a coker-furnace feed-stream into a coker furnace for producing a coker-drum feed stream; introducing the coker-drum feed stream to a coker drum; and introducing a hydrogen-donor gas into the coker-furnace feed stream. In some implementations of the present disclosure, the hydrogen-donor gas can be introduced into the coker-drum feed stream or the coker-drum feed stream and the coker-furnace feed stream, either simultaneously or not.

Some implementations of the present disclosure relate to a coker-fractionator unit that comprises: a coker furnace that is configured to heat a hydrocarbon feedstock; a coker drum that is configured for receiving and coking the heated hydrocarbon feedstock; a source of a hydrogen donor gas; a first conduit for providing fluid communication from the source of hydrogen-donor gas to upstream of the coker furnace; and a second conduit for providing fluid communication from the source of hydrogen-donor gas to between the coker furnace and the coker drum.

Without being bound by any particular theory, adding one or more hydrogen-donor gases upstream and/or downstream of the coker furnace can increase the operational efficiency of the coking process. Additionally, adding one or more hydrogen-donor gases upstream or downstream of the coker furnace can increase the weight and volumetric yield of the coker drum products that are conducted to the fractionator. An increased weight and volumetric yield of products, in particular liquid products, can cause a shift in a coker drum coke product and gas product towards more valuable liquid products like gasoil, kerosene and naphtha cuts.

BRIEF DESCRIPTION OF THE DRAWINGS

These and other features of the present disclosure will become more apparent in the following detailed description in which reference is made to the appended drawings, which illustrate by way of example only:

FIG. 6 shows an example of steps in methods of operating a coker unit, according to implementations of the present disclosure, wherein

DETAILED DESCRIPTION

Implementations of the present disclosure relate to a method of operating a coker unit. The method includes the steps of: collecting a coker-furnace feed stream; introducing the coker-furnace feed-stream into a coker furnace for producing a coker-drum feed stream; and introducing a hydrogen-donor gas into either or both of the coker-furnace feed stream or the coker-drum feed stream. The hydrogen-donor gas can be introduced into both of the coker-furnace feed stream and the coker-drum feed stream simultaneously or at different times of operation.

As used herein, the term "about" refers to an approximately +/−10% variation from a given value. It is to be understood that such a variation is always included in any given value provided herein, whether or not it is specifically referred to.

Implementations of the present disclosure will now be described by reference to FIG. 1 to FIG. 6.

Figure 1:
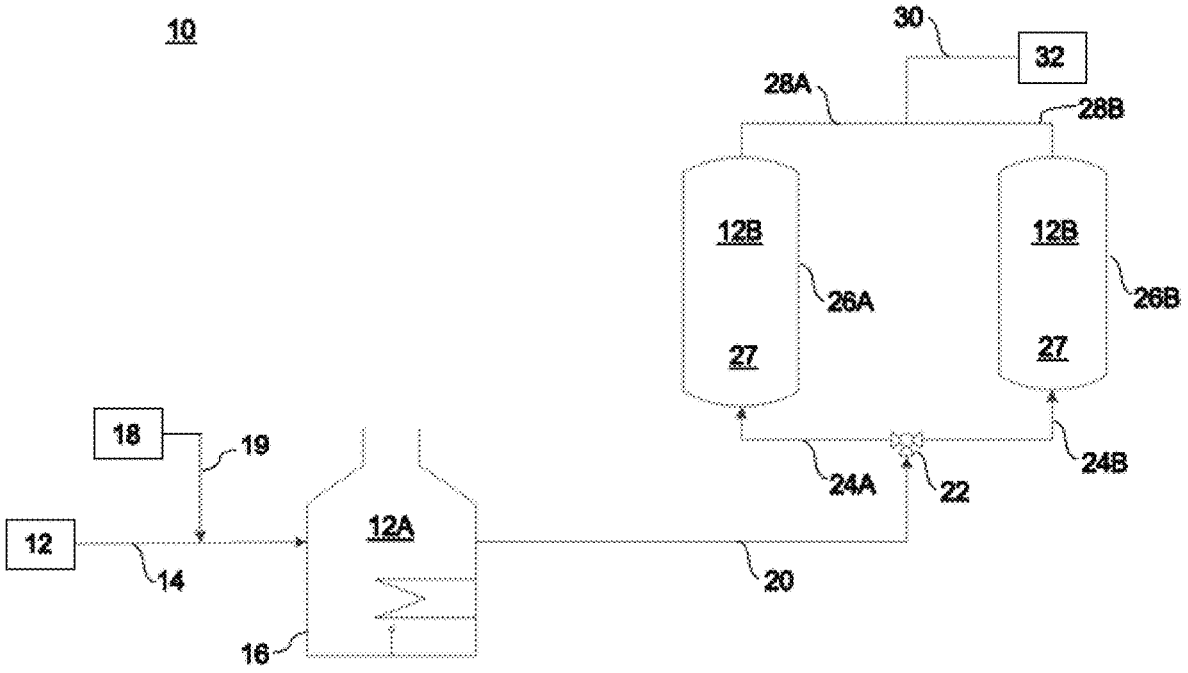
FIG. 1 shows a typical delayed-coking unit.

FIG. 1 shows a thermal cracking system with an example of a known coker-fractionator unit 10. The coker-fractionator unit 10 includes at least a coker heater 16, at least two coker drums 26A, 26B and a conduit 30 for conducting coker-drum product to a fractionator 32. The thermal cracking system can be any of the following types: a delayed coker system, a fluid coker system, a fluid catalytic cracking system or any other type of thermal cracking system that is used in a hydrocarbon refinery. For fluid catalytic cracking units, it is understood that a reactor is typically used in place of a coker drum. While FIG. 1 shows only two coker drums 26A and 26B, there can be multiple coker drums present with each in fluid communication with the fractionator 32 through one or more conduits 28A, 28B.

The coker furnace 16 receives a hydrocarbon feedstock 12 via a conduit 14. The hydrocarbon feedstock 12 can refer to an input stream that consists of heavy hydrocarbons, for example heavy hydrocarbons that can be sourced from an upstream process that processes vacuum topped bitumen, atmospheric topped bitumen, other sources of bitumen, oil and/or gas or combinations thereof. The hydrocarbon feedstock 12 contains various hydrocarbon components from which desirable hydrocarbon products can be isolated by processing in the coker unit 10. Optionally, a source of steam 18 can be fluidly communicated into the conduit 14 by a further conduit 19.

The coker furnace 16 heats the hydrocarbon feedstock 12 to between about 900 degrees Fahrenheit (° F.) and about 950° F. The heated hydrocarbon feedstock 12A is conducted to a valve 22 by a furnace conduit 20. The valve 22 controls the flow of the heated hydrocarbon feedstock 12A to one of two coker drums 26A or 26B via a coker-drum feed conduit 24A or a coker-drum feed conduit 24B, respectively. As will be appreciated by one skilled in the art, when there are two coker drums 26A, 26B, the valve 22 is a three-way valve. However, if there are more than two coker drums 26A, 26B, the valve 22 may be a different type of valve that controls the flow of the heated hydrocarbon feedstock 12A between the more than two coker drums.

Within the coker drums 26A, 26B, the heated hydrocarbon feedstock 12A is soaked to produce a coker-drum product 12B through a thermal-cracking process, which is referred to as coking. The coker-drum product 12B is made up of cracked hydrocarbon vapor, cracked hydrocarbon liquids and solid coke-particles. The coker-drum product 12B can also be referred to as a cracked hydrocarbon product or coker drum effluent. The coker-drum product 12B can include a wide range of constituents including non-hydrocarbons and hydrocarbons. The non-hydrocarbon constituents can include, but are not limited to: hydrogen ($H_2$) and hydrogen sulfide ($H_2S$). The hydrocarbon constituents within the coker-drum product 12B can include, but are not limited to: methane ($CH_4$), C2 to C4 hydrocarbons, a naphtha fraction, a kero fraction, and a gas oil fraction. The boiling point of the hydrocarbon constituents of the cracked hydrocarbon vapor can be as high as 1050° F.

The coker drum product 12B is communicated by one or more product conduits 28A, 28B, 30 to a fractionator 32 for boiling-point separation of the hydrocarbon constituents.

Figure 2:
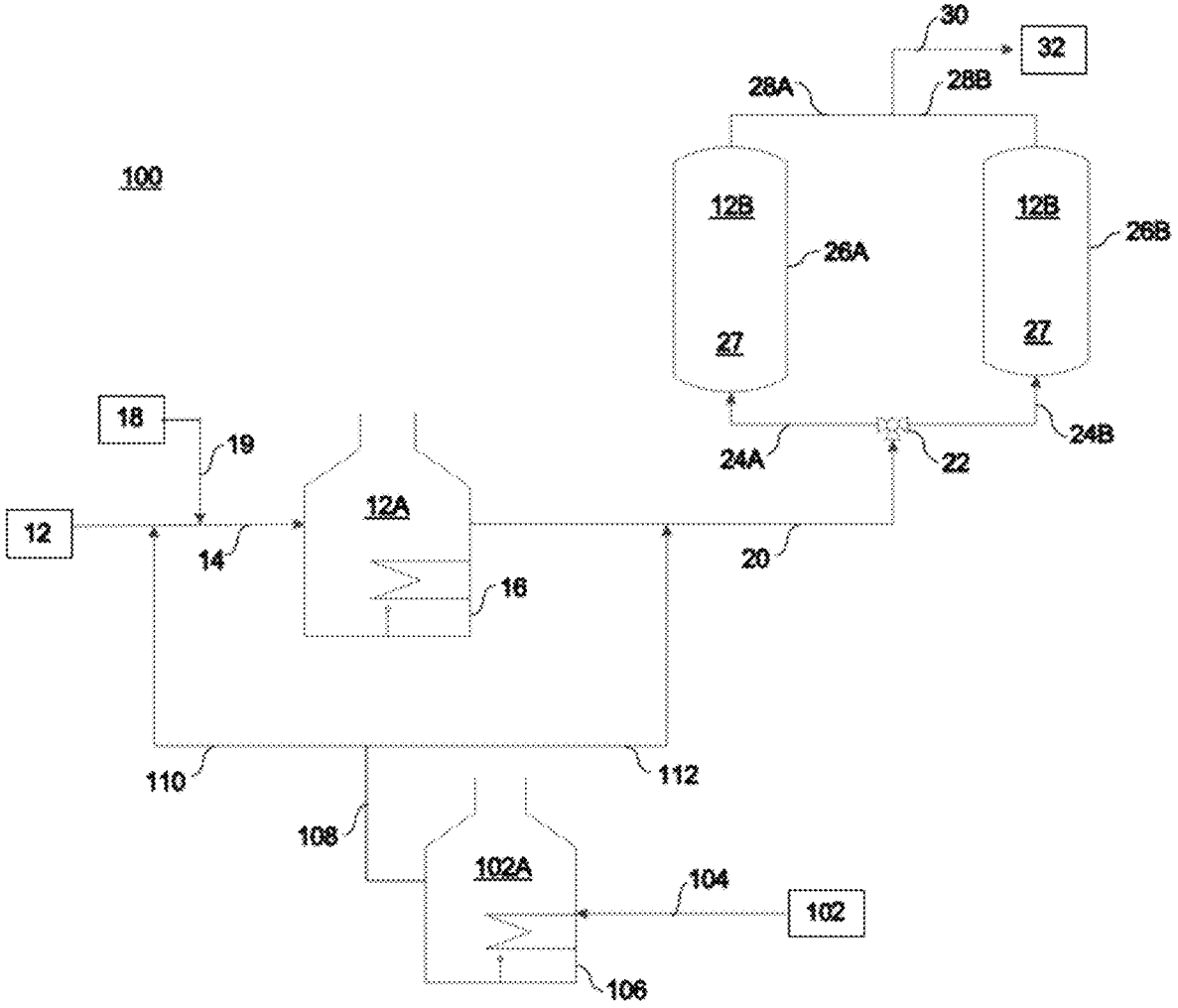
FIG. 2 shows one example of an implementation of the present disclosure for use with the coking unit shown in FIG. 1.

FIG. 2 shows an example of another thermal cracking process that includes a coker-fractionator unit 100 according to implementations of the present disclosure. The coker-fractionator unit 100 has some of the same components and operates some of the same process steps as the coker-fractionator unit 10 described above and shown in FIG. 1. The coker-fractionator unit 100 also includes one or more conduits for communicating with a source of a hydrogen donor gas 102 with either the hydrocarbon feedstock 12 and/or the heated hydrocarbon feedstock 12A.

In some implementations of the present disclosure, the hydrogen donor gas 102 can be communicated to an additive heater 106 via a conduit 104. The additive heater 106 can be a conventional type of fired heater that is used in refinery operations that can heat the hydrogen donor gas 102 to a temperature of between about 900° F. and about 950° F. The heated hydrogen donor gas 102A is communicated to the conduit 14, the furnace conduit 20 or both. For example, a conduit 108 can conduct the heated hydrogen donor gas 102A from the additive heater 106 into either or both of a conduit 110 and a conduit 112. The conduit 110 communicates the heated hydrogen donor gas 102A to conduit 14 so that the heated hydrogen donor gas 102A mixes with the hydrocarbon feedstock 12 upstream of the coker furnace 16. The conduit 112 communicates the heated hydrogen donor gas 102A to conduit 20 so that the heated hydrogen donor gas 102A mixes with the heated hydrocarbon feedstock 12A downstream of the coker furnace 16.

The hydrogen donor gas 102 can be any type of gas that will donate hydrogen atoms into the hydrocarbon feedstock 12 and/or the heated hydrocarbon feedstock 12A. Some examples of suitable hydrogen donor gas 102 includes, but are not limited to: hydrogen, an effluent from a hydrotreater process; methane, butane, or combinations thereof. The hydrotreater process is used to reduce or remove a sulfur content from hydrocarbon-based fluids such as natural gas and boiling-point separation products from the fractionator 32. The effluent from the hydrotreater can comprise hydrogen, saturated C1 through C6 hydrocarbons, unsaturated C1 through C6 hydrocarbons, cyclic C3 through C6 hydrocarbons, C6 through C18 aromatic hydrocarbons and combinations thereof. Table 1 below provides example ranges of the percent volume (Vol %) each constituent can contribute to the effluent from the hydrotreater.

TABLE 1

Different percent volume (Vol %) contributions of constituents to composition of hydrotreater effluent.

| Constituent | Vol % |
|---|---|
| $H_2$ | 15-25 |
| $C_1$ | 20-28 |
| $C_2$ | 1-3 |
| $C_2$ (ethene) | 3-7 |
| $C_3$ | 3-6 |
| $iC_4$ | 0.5-2 |
| $nC_{-4}$ | 2-4 |
| $iC_5$ | 0.2-1 |
| $nC_5$ | 0.5-1.2 |
| $H_2S$ | 32-38 |

The hydrogen donor gas 102 can be introduced into the conduit 14 and/or the furnace conduit 20 at a rate of between about 1 wt % to about 15 wt % of the total feed rate that is fed to the coker heater 16. In some implementations, the hydrogen donor gas 102 is mixed at a rate of between about 1 wt % and about 5 wt % of the feed.

Figure 3:
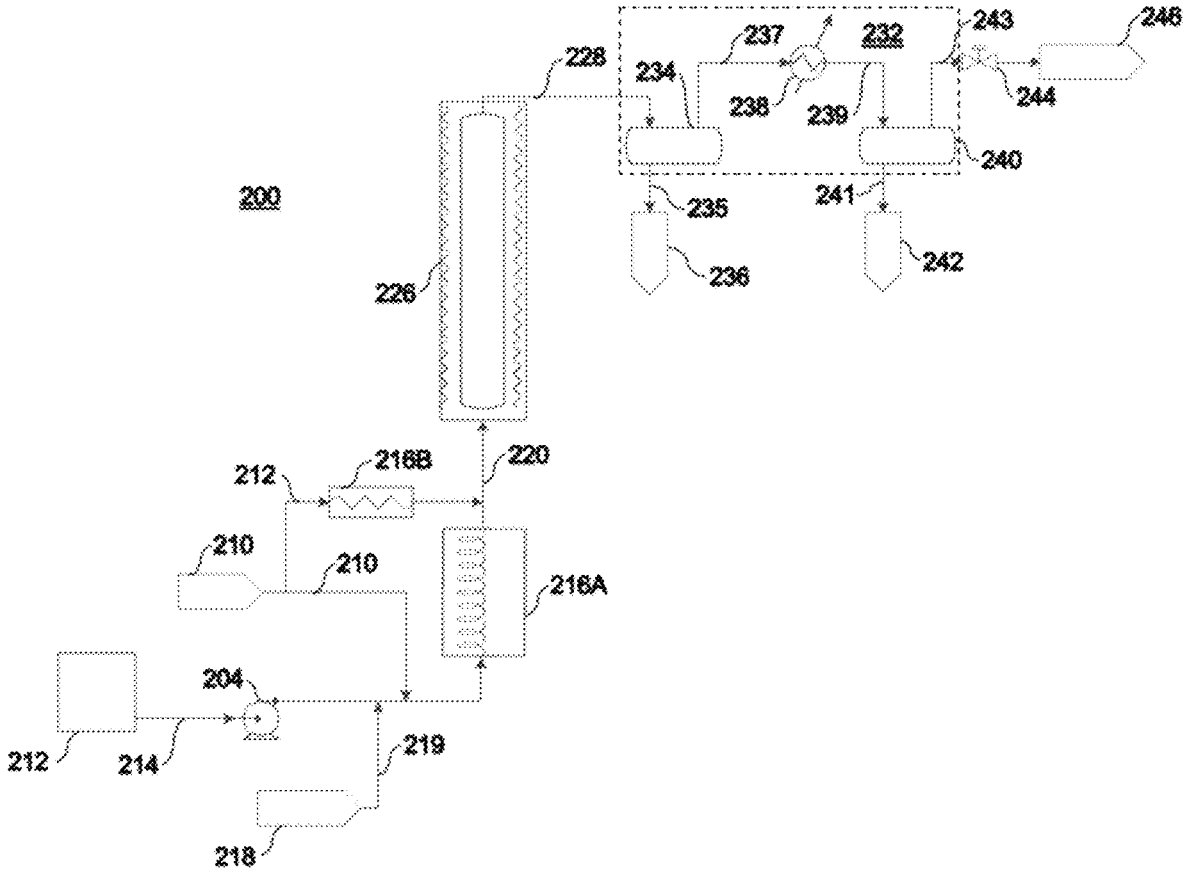
FIG. 3 shows an example of an experimental set-up that was used to obtain experimental data.

FIG. 3 shows an example of an experimental set up 200 that was used to mimic the process steps of the coker unit 100 to obtain experimental data under experimental conditions. The experimental set up 200 included a source 212 of a hydrocarbon bearing feed stream that was conducted by a conduit 214 to a feed pump 204 and then to a first heater 216A. A source of water and/or steam 218 was fluidly communicated to the conduit 214 by a conduit 219. A source of hydrogen-donor fluids 210 was fluidly communicated to the conduit 214. Optionally, the source of hydrogen-donor fluids 210 was fluidly communicated to a conduit 220 by a conduit 212 that fluidly communicated the first heater 216A to a coker drum 226. Optionally, the contents of the conduit 212 could pass through a second heater 216B. Coker drum 226 operated at a pressure of between about 35 pounds per square inch gauge (psig) and about 45 psig. The primary hydrocarbon-bearing fluid products from the coking process within the coker drum 226 were fluidly communicated to a separation process 232 by a conduit 228. The separation process 232 included a first separation process 234 that isolated heavy products, which were fluidly communicated to a heavy product vessel 236 by a conduit 235. The remaining contents of the first separation process 232 were fluidly communicated to a second separation process 240 by a conduit 237. The contents of the conduit 237 were cooled by a cooler 238. The second separation process 240 isolated valuable light products, which were fluidly communicated to a light product vessel 242 by a conduit 241. The remaining by-products from the second separation process 240 were fluidly communicated to a gas analyzer 246 and then they were flared as waste. Optionally, the contents within the conduit 243 passed through a pressure control valve 244 to regulate the flow towards the gas analyzer 246.

Figure 4:
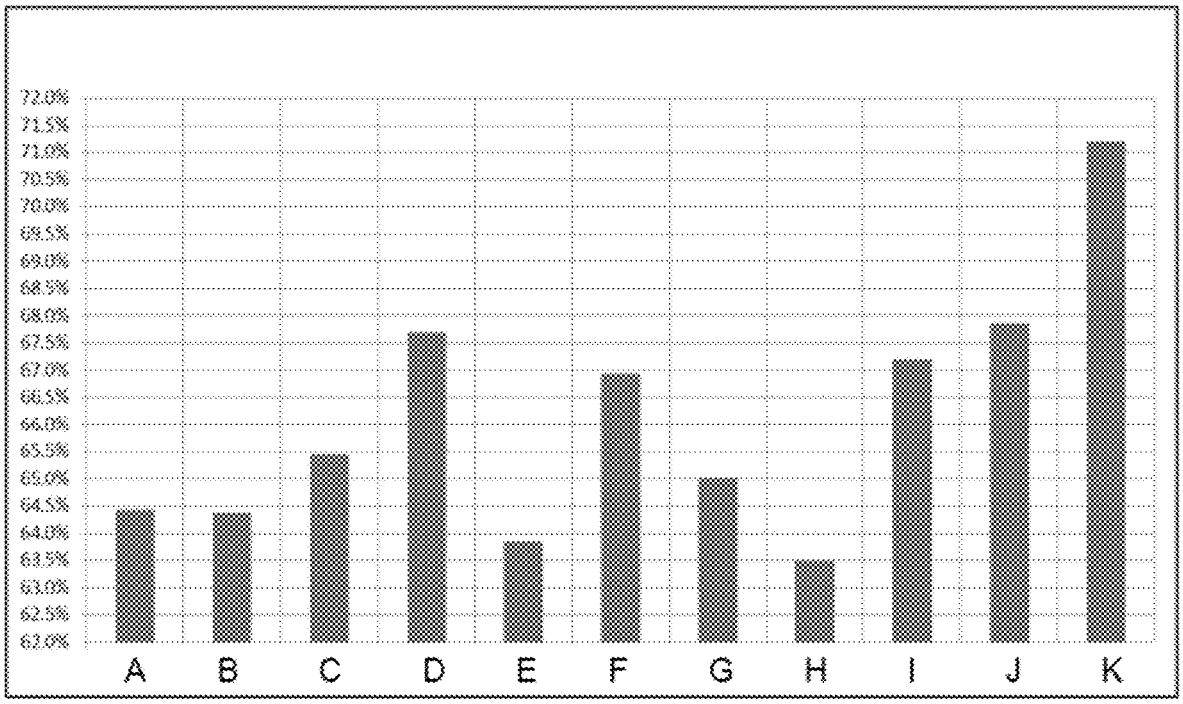
FIG. 4. shows an example of liquid coker product yield data obtained from using different embodiments of the present disclosure.

FIG. 4 shows an example of experimental liquid-yield data that was obtained using the experimental set up of FIG. 3. These experiments were conducted with the contents of the conduit 220 having a temperature of between about 930° F. to about 940° F., 40 psig at a flow rate of about 3,600 grams per hour. The contents of the conduit 228 had a temperature of between about 820° F. to about 830° F. In FIG. 4, Example A represents a base case that was a vacuum distillation unit bottom's residue, which is also referred to as 950° F.+ material, with no hydrogen donor added. The base case was used as the feed stream to the coker drum 226. FIG. 4 also shows the impact on liquid-yield data when various additives where added to the experimental set up of FIG. 3 via conduit 212. In particular, Example B represents 4 standard cubic feet per hour (SCFH) of a hydrotreater effluent; Example C represents 9 SCFH of hydrotreater effluent; Example D represents 17 SCFH of a hydrogen-gas containing hydrotreater effluent; Example E represents 4 SCFH of methane; Example F represents 9 SCFH of methane; Example G represents 4 SCFH of nitrogen; Example H represents 9 SCFH of nitrogen; Example I represents 4 SCFH of hydrogen gas; Example J represents 4 SCFH of butane; and, Example K represents 7.5 SCFH of butane. The addition of a hydrogen donor gas increased the percentage liquid product yield, as shown in Examples D, F, I, J and K in FIG. 4.

Table 2 shows the experimental results observed for the production, in weight percent (wt %), of gas, liquid and coke products from the base case. However, in other implementations of the present disclosure the feed stream can be a variety of hydrocarbon feeds including, but not limited to crude oil, heavy oil, mined oil-sands extract, steam assisted gravity drainage derived oil-sand extract, bitumen and other types of oil feed streams. Table 2 also shows the production, in weight percent (wt %), of gas, liquid and coke products after the addition of each of the additives described for FIG. 4. Table 3 shows the constituent contributions (vol %) of the hydrotreater effluent.

TABLE 2

Experimental Results of normalized gas yield, liquid yield and coke yield.

| Weight % (wt %) of additive | Gas wt % Normalized | Liquid wt % Normalized | Coke wt % Normalized |
|---|---|---|---|
| Base Case | 8.9% | 64.4% | 26.7% |
| 2 wt % $N_2$ | 9.2% | 65.0% | 25.8% |
| 1.6 wt % $CH_4$ | 10.0% | 63.9% | 26.2% |
| 5 wt % $CH_4$ | 8.3% | 67.0% | 24.7% |
| 1.7 wt % HT Gas | 9.1% | 64.4% | 26.5% |
| 5.5 wt % HT Gas | 7.5% | 65.8% | 26.6% |
| 9.1 wt % HT Gas | 8.1% | 67.8% | 24.2% |
| 1.5 wt % $H_2$ | 8.3% | 67.1% | 24.5% |
| 1 wt % $H_2$ | 8.6% | 63.5% | 27.9% |
| 6.5 wt % $C_4H_{10}$ | 5.0% | 67.9% | 27.1% |
| 13.7 wt % $C_4H_{10}$ | 3.3% | 71.2% | 25.5% |

TABLE 3

Constituent contribution (Vol %) to composition of hydrotreater effluent.

| Constituent | Vol % |
|---|---|
| $H_2$ | 32.0 |
| $C_1$ | 42.9 |
| $C_2$ | 8.3 |
| $C_3$ | 7.2 |
| $C_4$ | 9.6 |
| Total | 100 |

Figure 5:
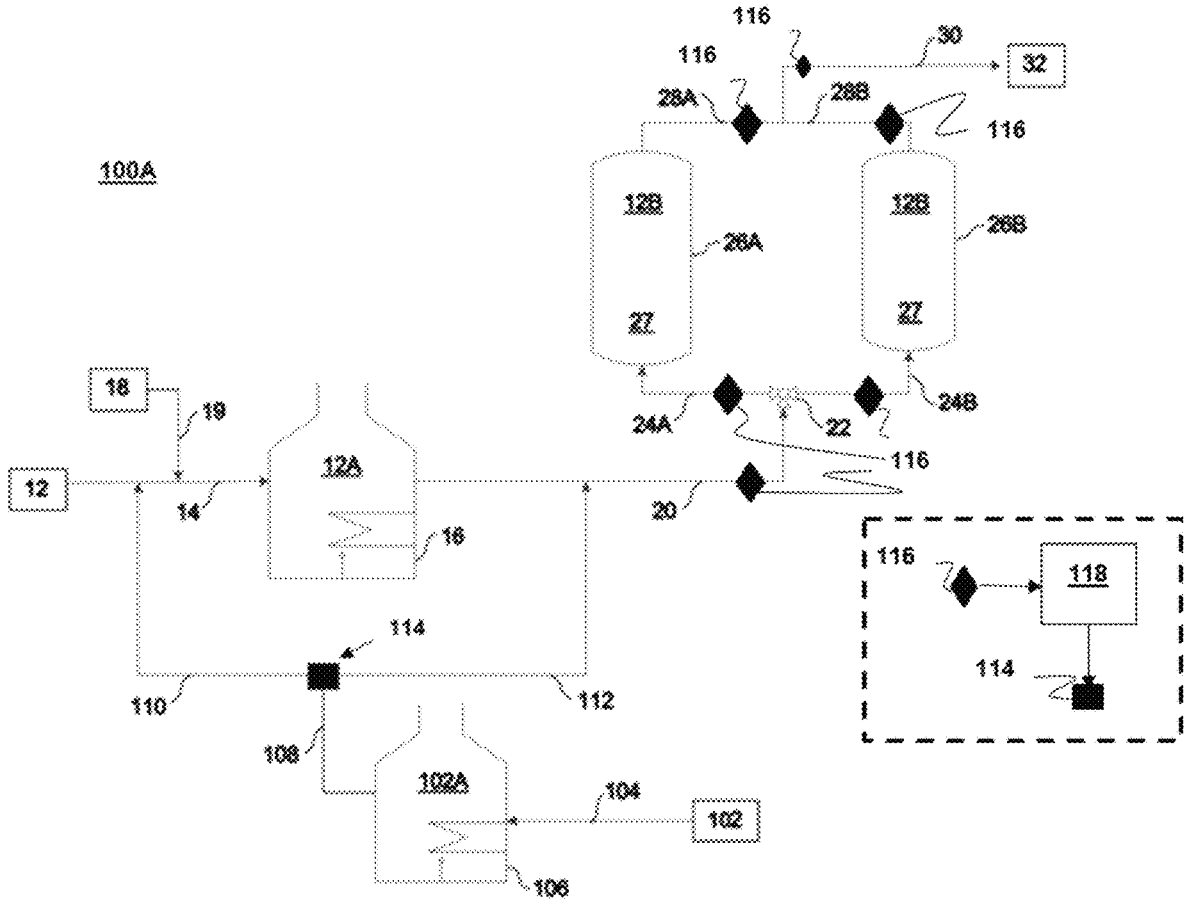
FIG. 5 shows another example of one implementation of the present disclosure for use with the coking unit of FIG. 3.

FIG. 5 shows an implementation of a coker fractionator unit 100A that is similar to the unit 100 shown in FIG. 3. A difference between the unit 100 (as shown in FIG. 3) and the unit 100A (as shown in FIG. 5) is that a switching member 114 is included within the unit 100A. The switching member 114 can control the amount of the heated hydrogen donor gas 102A that flows from the additive heater 106, within conduit 108, through either, both or neither of the conduit 110 and the conduit 112. Optionally, the conduit 104 can bypass the additive heater 106 and the flow therethrough is directed towards either or both of conduits 110, 112.

The switching member 114 can be any type of flow-control switch or valve that is configured for controlling flow within the dimensions of the conduits 108, 110 and 112 and for blocking the flow of the heated hydrogen donor gas 102A (or non-heated) down either or both of the conduits 110 and 112. For example, the switching member 114 can be a three-way valve. Furthermore, the switching member 114 can be configured to control the amount of heated hydrogen gas 102A that flows between the conduit 110 and the conduit 112 so that a first-desired percentage of the total amount of heated hydrogen gas 102A within the conduit 108 can flow through the conduit 110 and a second-desired percentage of the total amount of the heated hydrogen gas 102A within the conduit 108 can flow through the conduit 112. The sum of the first-desired percentage and the second-desired percentage will equal 100% of the total amount of heated hydrogen donor gas 102A within the conduit 108. For example, the first-desired percentage can be between 0% and 100% and the second-desired percentage can be between a corresponding 100% and 0%. In some implementations of the present disclosure, a pressure drop across the coker furnace 12A can be avoided or reduced by setting the second-desired percentage to less than 100%.

In some implementations of the present disclosure, the switching member 114 can be manually, hydraulically, pneumatically or electronically controlled by an operator so that the first-desired percentage and the second-desired percentage can be changed over time and, optionally, while the unit 100A is operating. In some implementations of the present disclosure the switching member 114 is configured to be controlled by an operator that is remote from the switching member 114. For example, it may be desirable to be able to change the flow of the heated hydrogen donor gas 102A to the conduit 110 and to the conduit 102B between starting a run of the unit 100A and ending a run of the unit 100A and the operator can change the flow of the heated hydrogen donor gas 102A from a control unit that is remote from the physical location of the switching member 114. The control unit can electronically communicate instructions to the switching member 114 by using one or more suitable wired or wireless communication technologies such as Ethernet, (WI-FI is a registered trademark of Wi-Fi Alliance, Austin, Tex., USA), BLUETOOTH® (BLUETOOTH is a registered trademark of Bluetooth Sig Inc., Kirkland, Wash., USA), ZIGBEE® (ZIGBEE is a registered trademark of ZigBee Alliance Corp., San Ramon, Calif., USA), 3G and 4G wireless mobile telecommunications technologies, and/or the like. In some implementations of the present disclosure, parallel ports, serial ports, USB connections, optical connections, or the like may also be used for supporting the electronic communication of instructions from the control unit to the switching member 114.

In some optional implementations of the present disclosure, one or more sensors 116 and a processing structure 118 are included in the unit 100A. The one or more sensors 116 are configured to detect one or more physicochemical properties of the contents of one or more of the furnace conduit 20, the coker-drum feed conduits 24A, 24B, the product conduits 28A, 28B or the conduit 30. In some implementations of the present disclosure the one or more sensors 116 can detect one or more physicochemical properties such as temperature, pressure, density, volume, mass, boiling point or other types of physicochemical properties that would be appreciated by one skilled in the art. The one or more sensors 116 are configured to electronically communicate the detected physicochemical properties to the processing structure 118 (see dashed line box in FIG. 5). The processing structure 118 can be a real-time processor, a programmable logic controller (PLC), a microcontroller unit (MCU), a μ-controller (UC), a specialized/customized process/controller using e.g., field-programmable gate array (FPGA) or an application-specific integrated circuit (ASIC) technology, and/or the like. The processing structure 118 can also be one or more single-core or multiple-core computing processors such as an INTEL® microprocessor (INTEL is a registered trademark of Intel Corp., Santa Clara, Calif., USA), an AMD® microprocessor (AMD is a registered trademark of Advanced Micro Devices Inc., Sunnyvale, Calif., USA), an ARM® microprocessor (ARM is a registered trademark of Arm Ltd., Cambridge, UK) manufactured by a variety of manufactures such as Qualcomm of San Diego, Calif., USA, under the ARM® architecture, or the like. The electronic communication between the one or more sensors 116 and the processing structure 118 can be as described above regarding the electronic communication between the control unit and the switching member 114.

The processing structure 118 is configured to compare previously communicated physicochemical properties and to identify any changes in the detected physicochemical properties over time, or otherwise. The processing structure 118 can then follow a predetermined course of actions based upon any change in the detected physicochemical properties. For example, the processing structure 118 can electronically communicate instructions to remotely actuate the switching member 114 to change, either increase or decrease, the first-desired percentage, which in turn can cause a corresponding change in the second desired-percentage (see dashed line box in FIG. 5). Additionally, the processing structure 118 can electronically communicate instructions to the switching member 114 to actuate and stop the flow of hydrogen-donor gas through both of the conduits 110, 112. The electronic communication between the processing structure 118 and the switching member 114 can be as described above regarding the electronic communication between the control unit and the switching member 114.

Figure 6A:
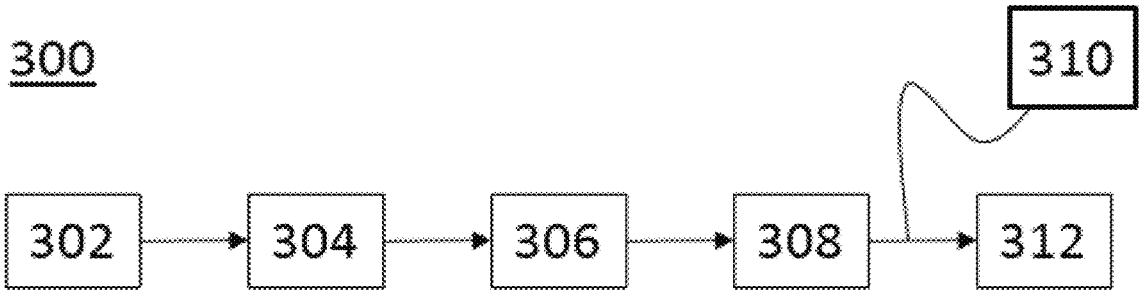
FIG. 6A shows the steps of one method.

FIG. 6A shows a schematic of the steps of one implementation of a method 300 for operating a coker unit. The method 300 comprises the steps of collecting a coker-furnace feed stream 302; introducing 304 the coker-furnace feed-stream into a coker furnace for producing a coker-drum feed stream; introducing 306 the coker-drum feed stream to a coker drum; and introducing 308 a hydrogen-donor gas into either or both of the coker-furnace feed stream or the coker-drum feed stream. In some implementations of the present disclosure, the hydrogen-donor gas that is introduced in step 308 is one of methane, butane, isobutene, a hydrotreater effluent, or combinations thereof. In some implementations of the present disclosure, the hydrogen-donor gas can be heated. In some implementations of the present disclosure, the step of introducing 308 involves introducing all of the hydrogen-donor gas at least partially into the coker-furnace feed stream and at least partially into the coker-drum feed. In some implementations of the present disclosure, the method 300 can include an optional step of controlling 310 the amount of the hydrogen-donor gas that is introduced into the coker-furnace feed stream and into the coker-drum feed stream. For example, a first-desired percentage of the total amount of the hydrogen-donor gas can be introduced into the coker-furnace feed stream and a second-desired percentage of the total amount of the hydrogen-donor gas can be introduced into the coker-drum feed stream. The sum of the first-desired percentage and the second-desired percentage will equal 100% of the total amount of hydrogen-donor gas that is being introduced over time. The step of controlling 310 can also include a step of changing the amount of hydrogen-donor gas that is introduced into the coker-furnace feed stream and the coker-drum feed so that the total amount of the hydrogen-donor gas that is introduced does not change but the first-desired percentage of the hydrogen-donor gas that is introduced into the coker-furnace feed stream increases or decreases. An increase or decrease in the first-desired percentage can cause a corresponding increase or decrease in the second-desired percentage of hydrogen-donor gas that is introduced into the coker-drum feed stream.

Figure 6B:
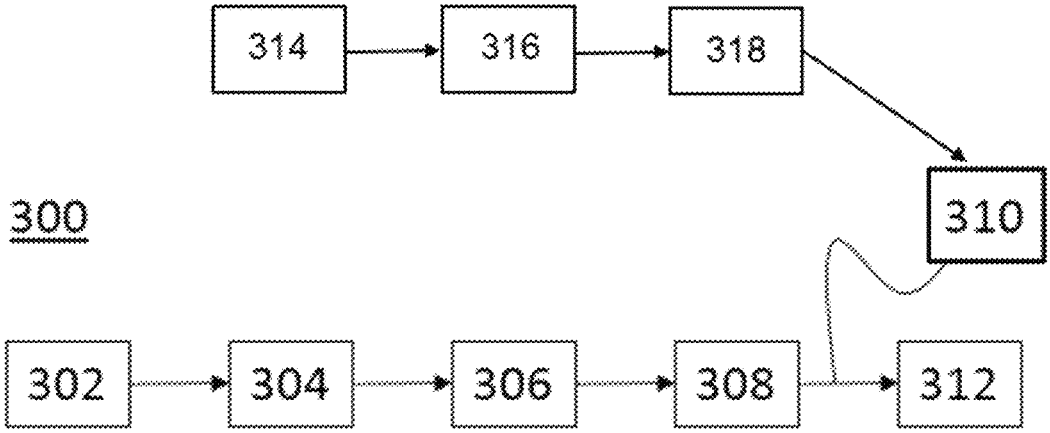
FIG. 6B shows the further optional steps of the method of FIG. 6A.

FIG. 6B shows optional further steps of the method 300. The further steps can include a step of detecting 314 one or more physicochemical properties of the contents of one or more conduits within a coker-fractionator unit. The detected properties can be electronically communicated to a processing structure for performing a step of processing 316. During the processing step 316 previously communicated detected-properties can be compared against newly communicated properties for a step of determining 318 whether there has been a change in the one or more detected properties over time and if that step of determining 318 indicates that a change has occurred, the processing structure can then perform one or more predetermined actions that are each based upon a predetermined indicia of the nature of the change in the detected properties. The indicia of change can include, but are not limited to: what type of physicochemical property has changed; the amplitude of the change; whether the change is an increase or a decrease in the detected property, or otherwise. If during the determining step 318 it is determined that a change in the one or more detected properties has occurred, or due to the passage of run time that the coker-fractionator unit is operating, the step of controlling 310 and/or the step of changing the amount of hydrogen-donor gas that is introduced into the coker-furnace feed stream and the coker-drum feed can be altered by changing the controlling step 310.

Any products from step 308 can be conducted to a further processing step for separating 312 the products into different commercially valuable streams and one or more waste streams. For example, the step of separating 312 can be a fractionation and/or distillation separation process.

We claim:

1. A method of operating a coker unit comprising the steps of:

a) introducing a coker-furnace feed-stream into a coker furnace for producing a coker-drum feed stream;

b) introducing the coker-drum feed stream to a coker drum; and c) introducing a hydrogen-donor gas into the coker-drum feed stream, wherein the hydrogen-donor gas is introduced into the coker-drum feed stream at a rate of between 2 wt % to about 15 wt % of a total feed rate of the coker-furnace feed stream, and wherein the hydrogen-donor gas is one of hydrogen, methane, butane, isobutene, a hydrotreater off-gas, and combinations thereof.

2. The method of claim 1, further comprising a step of introducing the hydrogen-donor gas into a coker-furnace feed stream.

3. The method of claim 2, wherein the hydrogen-donor gas is introduced into the coker-drum feed stream and the coker-furnace feed stream simultaneously.

4. The method of claim 2, further comprising a step of alternating between introducing the hydrogen-donor gas into the coker-furnace feed stream and the coker-drum feed stream.

5. The method of claim 1, wherein the hydrogen-donor gas is methane.

6. The method of claim 1, wherein the hydrogen-donor gas is butane.

7. The method of claim 1, wherein the hydrogen-donor gas is isobutene.

8. The method of claim 1: wherein the hydrogen-donor gas is a hydrotreater effluent.

9. The method of claim 1, further comprising a step of controlling a first-desired percentage of the hydrogen-donor gas that is introduced into the coker-furnace feed stream.

10. The method of claim 9, further comprising a step of controlling a second-desired percentage of the hydrogen-donor gas that is introduced into the coker-drum feed stream.

11. The method of claim 10, further comprising a step of changing the first-desired percentage and the second-desired percentage.

12. The method of claim 1, further comprising a step of determining one or more physicochemical properties of a fluid within the coker-fractionator unit.

13. The method of claim 12, further comprising a step of controlling a first-desired percentage of the hydrogen-donor gas that is introduced into the coker-furnace feed stream based upon the step of determining.

14. The method of claim 12, further comprising a step of controlling a second-desired percentage of the hydrogen-donor gas that is introduced into the coker-drum feed stream based upon the step of determining.

* * * * *